US010006746B2

(12) United States Patent
Searle et al.

(10) Patent No.: US 10,006,746 B2
(45) Date of Patent: Jun. 26, 2018

(54) IMPELLER CAVITATION SYSTEM

(71) Applicant: Maritime Arresting Technologies, Tarpon Springs, FL (US)

(72) Inventors: Matthew John Searle, Tarpon Springs, FL (US); Shawn Peter Spilde, Seminole, FL (US)

( * ) Notice: Subject to any disclaimer, the term of this patent is extended or adjusted under 35 U.S.C. 154(b) by 0 days. days.

(21) Appl. No.: 14/833,233

(22) Filed: Aug. 24, 2015

(65) Prior Publication Data

US 2016/0102955 A1 Apr. 14, 2016

(30) Foreign Application Priority Data

Sep. 17, 2014 (GB) ..... 1416475.0

(51) Int. Cl.

| | |
|---|---|
| ***F41H 13/00*** | (2006.01) |
| ***F42B 12/58*** | (2006.01) |
| ***F42B 12/74*** | (2006.01) |
| ***F42B 30/00*** | (2006.01) |
| ***B63G 13/00*** | (2006.01) |

(52) U.S. Cl.

CPC ..... *F41H 13/00* (2013.01); *B63G 13/00* (2013.01); *F42B 12/58* (2013.01); *F42B 12/745* (2013.01); *F42B 30/00* (2013.01)

(58) Field of Classification Search

CPC ..... F42B 12/74; F42B 12/745; F42B 12/58; F42B 30/00; F41H 13/00; B63G 9/00; B63G 13/00

USPC ..... 102/399, 501, 502, 517, 293, 504; 89/1.11, 1.1; 441/1, 21, 28, 136, 6; 114/264, 267, 382

See application file for complete search history.

(56) References Cited

U.S. PATENT DOCUMENTS

| | | | | |
|---|---|---|---|---|
| 5,273,468 | A * | 12/1993 | Nichols | B63B 22/08 441/26 |
| 5,411,424 | A * | 5/1995 | Hill | B63B 22/16 441/11 |
| 5,922,379 | A * | 7/1999 | Wang | A23J 3/26 106/162.5 |
| 6,394,016 | B2 * | 5/2002 | Swartout | B63B 21/56 114/254 |
| 6,431,931 | B2 * | 8/2002 | Johnson | 43/44.87 |
| 7,067,651 | B2 * | 6/2006 | Poovarodom | C08L 3/02 536/124 |
| 7,303,453 | B1 * | 12/2007 | Bourke | B63B 22/22 441/30 |
| 7,441,511 | B2 * | 10/2008 | Farinella | B63H 25/50 114/382 |
| 7,975,639 | B2 | 7/2011 | Bishop | |
| 8,176,867 | B2 * | 5/2012 | Gayton | B63G 13/00 114/240 D |

(Continued)

*Primary Examiner* — James S Bergin

(57) ABSTRACT

A method and apparatus for stopping an impeller-driven watercraft is includes distributing a plurality of submunitions in advance of a path of the impeller-driven watercraft. Each of the submunitions includes a buoyant member, a first end cap, and a second end cap; the second end cap is heavier than the first end cap. A lanyard connects the first end cap to the second end cap, optionally passing through the buoyant member. At least one of the submunitions enters an intake vent of the impeller-driven watercraft and attaches to a blade of an impeller of the impeller-driven watercraft, causing cavitation and imbalance, thereby slowing the impeller-driven watercraft.

5 Claims, 5 Drawing Sheets

(56) References Cited

U.S. PATENT DOCUMENTS

| | | | | |
|---|---|---|---|---|
| 8,402,894 | B1 | 3/2013 | McGuigan | |
| 8,479,655 | B1 * | 7/2013 | Gamache | F42B 12/46 102/370 |
| 9,003,996 | B2 * | 4/2015 | Meadow | B63B 21/48 114/294 |
| 2005/0016372 | A1 * | 1/2005 | Kilvert | F41H 13/0006 89/1.34 |
| 2013/0330988 | A1 * | 12/2013 | Oddo | B63C 9/03 441/11 |

* cited by examiner

IMPELLER CAVITATION SYSTEM

CROSS-REFERENCE TO RELATED APPLICATION

This application claims the benefit of Great Britain provisional application no. GB1416475.0 titled, "Impeller Cavitation System," filed on Sep. 17, 2014.

FIELD

This invention relates to the field of law enforcement and more particularly to a system for creating floating security barriers against vessels propelled by water jet or impeller drives.

BACKGROUND

There exists a need for law enforcement to be able to stop watercraft for boarding, inspection, and possible arrests and confiscation of contraband. In many jurisdictions, probable cause is not sufficient reason for opening fire on a watercraft and/or an operator of that watercraft. Often, well equipped law enforcement watercrafts are able to go faster than a suspect's watercraft, but without firing of a weapon, it is difficult to force the suspect to slow down and stop for boarding. The issue is further complicated by potential risk to the public should the suspect lose consciousness and the watercraft continues to move as well as the environmental concerns should fluids escape from the watercraft after being shot.

Certain vessels can be stopped by use of prop entanglement systems such as US Coast Guard SNARE as described in U.S. Pat. No. 8,402,894 or US Coast Guard RGES as described in U.S. Pat. No. 7,975,639. Some law enforcement agencies run alongside the suspect's watercraft and shoot the engines of such vessels with specially designed rounds of ammunition that are designed to disable the engine of a vessel. These existing systems and techniques do not work on small personal watercraft such as jet skis with jet drives consisting of an impeller in a tubular housing. Any watercraft lacking an exposed propeller is unaffected by running over existing entanglement systems. Furthermore, in many such watercrafts, the engine is located close to the driver or possibly between the driver's legs making it impossible to shoot at the engine without risking life and limb of the driver or any passengers. There are situations where the operator is unconscious or otherwise incapacitated and the watercraft needs to be stopped without hurting the operator.

With respect to maritime and riverine law enforcement, there exists a problem in not being able to stop certain classes of watercraft such as small personal watercraft, often referred to as jet skis.

What is needed is a system that will stop or slow watercraft that utilize internal impellers for propulsion.

SUMMARY

One aspect of the present invention provides a floating submunition that, after being sucked into the inlet of a jet drive and hit by the impeller, causes the impeller to cavitate. The submunition is hit by the advancing impeller blade, deforms around the leading edge of the impeller blade and creates cavitation as it is swept around the jet drive unit.

In order to be sucked into the inlet of the jet drive, the submunition is designed to float, preferably in a vertically orientation. The submunition includes a buoyant body and a weight at one end to maintain an upright posture.

In some embodiments, multiple submunitions are placed in a cartridge that is fired in advance of the suspect's watercraft, for example, by a pneumatic launcher, a rocket, firearm, or a spigot mortar, sending the multiple submunitions into the water in front of the suspect's watercraft so that one or more of the submunitions are sucked into the inlet of the jet drive of the suspect's watercraft.

In some embodiments, the buoyant portion of the submunitions is made of closed cell foam or other highly buoyant material, or, in some embodiments, the buoyant portion is a sealed container or tube having a gas or air within the container to provide buoyancy.

In some embodiments, multiple submunitions are placed in a grenade or bomb that is detonated in advance of the suspect's watercraft. In some embodiments, the submunitions are deployed using a sabot that opens once the round has left the barrel of the launcher.

In some embodiments, the materials used to produce the submunitions are selected to biodegrade over relatively short time periods.

In one embodiment, the submunition consists of a buoyant float with a weight at one end and a retaining element such a disc at the other end. A cord, line or wire runs through the buoyant float, joining the weight and the retaining element. It is anticipated that the weight be metal or ceramic with a central hole through which the cord/line/wire runs and is attached.

In some embodiments, the submunitions are between 0.25 inches and 1.5 inches in diameter to facilitate passing through input grates of target watercraft. In some embodiments, the submunitions are less than 1.0 inch in diameter to facilitate passing through input grates of target watercraft. In some embodiments, the submunitions are less than 4.0 inches long to facilitate passing through input grates of target watercraft.

In some embodiments, the submunitions are provided with a range or mix of diameters and lengths to facilitate passing through input grates of target watercraft.

In some embodiments, the submunitions have a proportion of their length above the water when floating vertically, and in some such embodiments between one tenth and one third of the submunitions length is above the water when floating vertically, assuming distilled water.

In one embodiment, a submunition is disclosed including a buoyant member, a first end cap and a second end cap. A lanyard (or other connecting member) connects the first end cap to the second end cap, in some examples, passing through the buoyant member. The second end cap is heavier than the first end cap promoting an upright orientation when suspended in a fluid such as water.

In another embodiment, a method of stopping an impeller-driven watercraft is disclosed including distributing a plurality of submunitions in advance of a path of the impeller-driven watercraft, each of the submunitions includes a buoyant member, a first end cap, and a second end cap; the second end cap is heavier than the first end cap. A lanyard (or other connecting member) connects the first end cap to the second end cap. At least one of the submunitions enters an intake vent of the impeller-driven watercraft and attaches to a blade of an impeller of the impeller-driven watercraft, causing cavitation and imbalance, thereby slowing the impeller-driven watercraft.

In another embodiment, a submunition is disclosed including a buoyant member made of low-density polyethylene foam, a first end cap made of steel and a second end cap also made of steel, the second end cap being heavier than the first end cap. A lanyard (or other connecting member) connects the first end cap to the second end cap, passing through the buoyant member.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
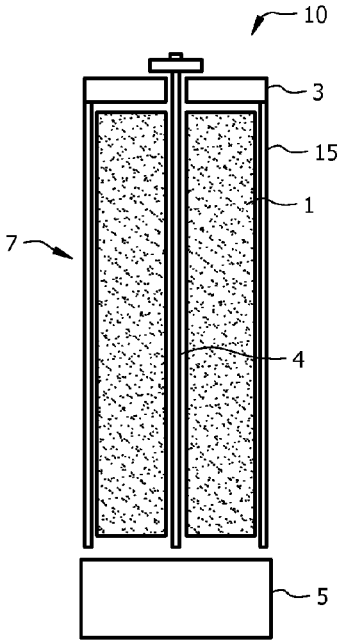
FIG. 1 illustrates a cross sectional view of a submunition.
Figure 2:
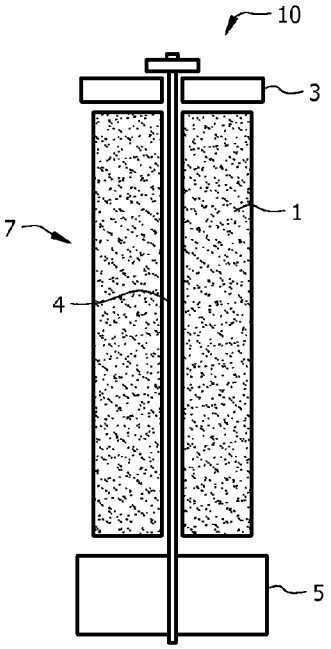
FIG. 2 illustrates a cross sectional view of a submunition.

Reference will now be made in detail to the presently preferred embodiments of the invention, examples of which are illustrated in the accompanying drawings. Throughout the following detailed description, the same reference numerals refer to the same elements in all figures.

Figure 7:
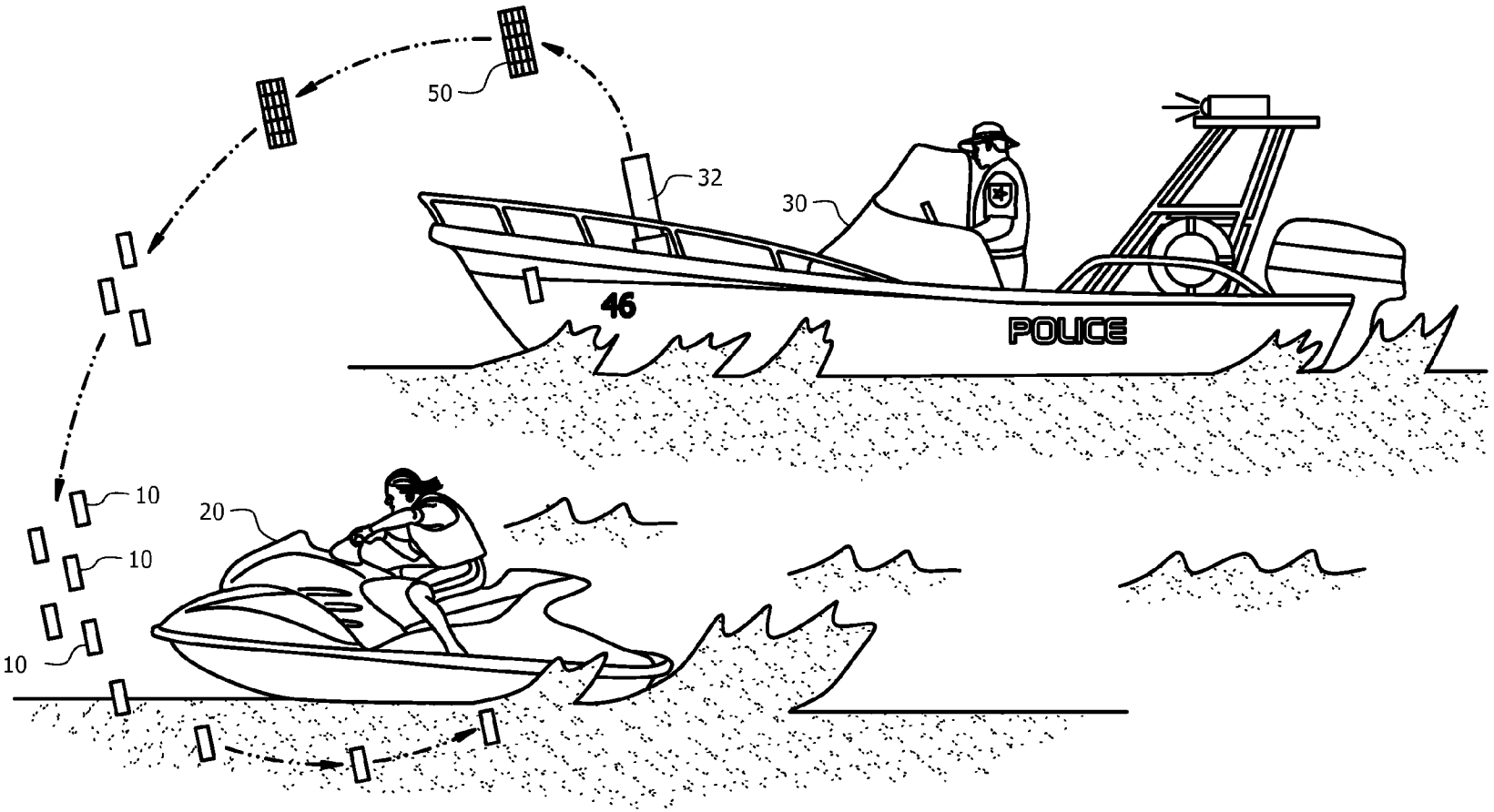
FIG. 7 illustrates the deployment of one or more submunitions in advance of a watercraft.
Figure 8:
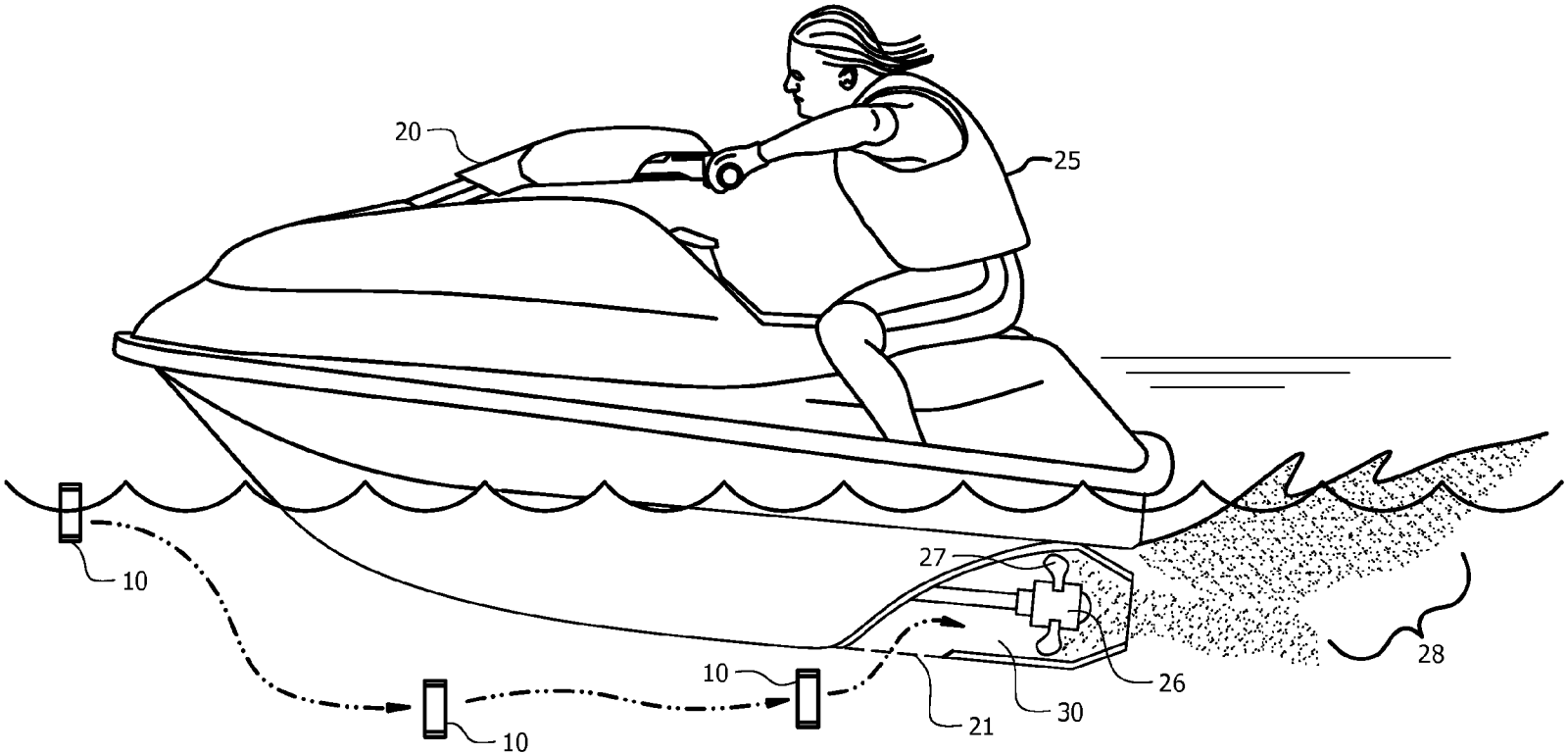
FIG. 8 illustrates one of the submunitions entering the intake of a watercraft.
Figure 9:
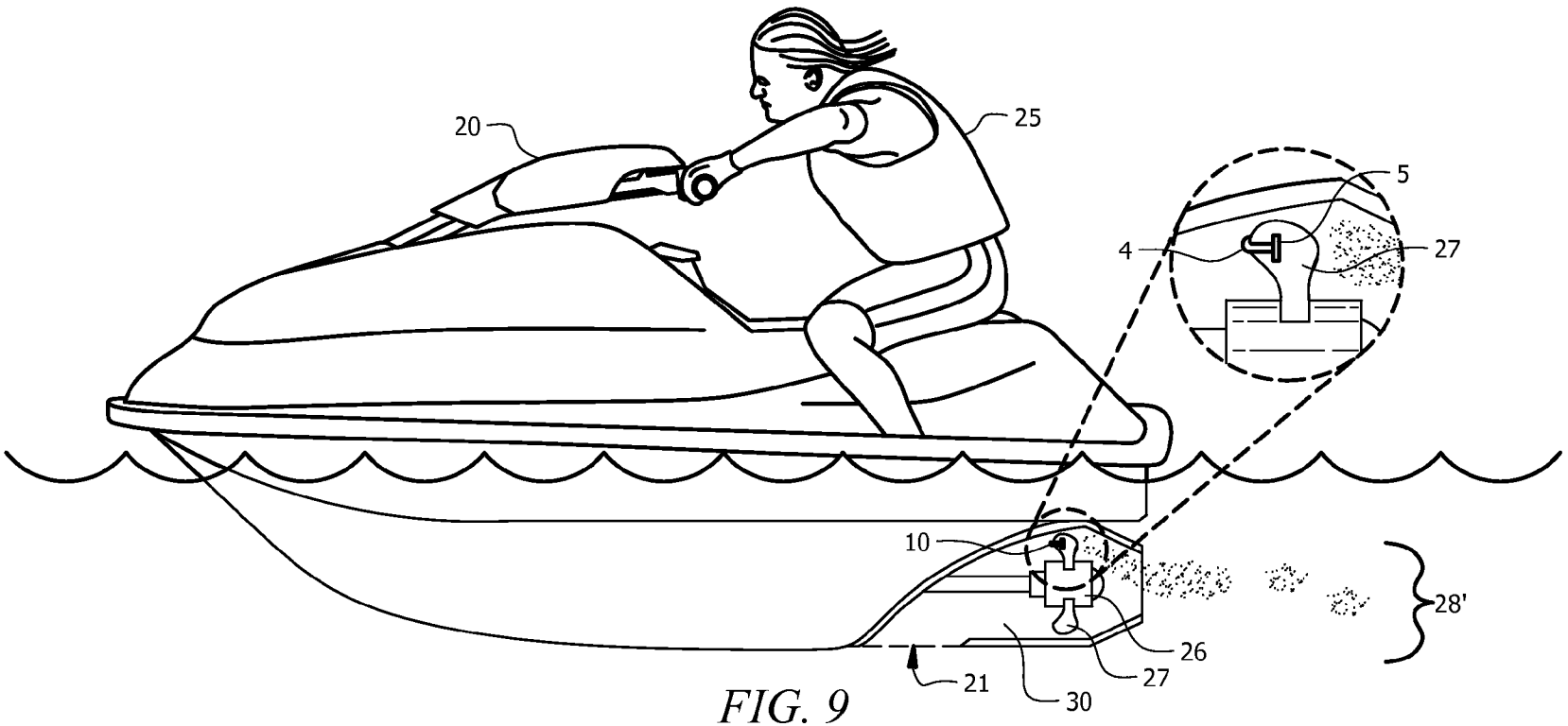
FIG. 9 illustrates one of the submunitions adhering to a blade of an impeller of a watercraft.

Referring to FIGS. 1-5, cross sectional views and end views of a submunition 10 are described. The submunition 10 is an impeller jamming system. As shown in FIGS. 7-9, one or more of the submunitions 10 is launched into the water in front of a watercraft 20 (any impeller-propelled watercraft 20 such as a jet ski, etc.). The intent is for one or more of the submunitions 10 to clamp onto a blade 27 of the impeller 26 (see FIG. 8) of the watercraft 20. Once one or more submunitions 10 clamp onto the blade 27 of the impeller 26, the submunition(s) 10 move with the blade 27 of the impeller 26 as it rotates, causing cavitation within the impeller cavity 30, reducing the thrust 28/28' and slowing the watercraft 20 for boarding by, for example, a law enforcement personnel.

It is desired that the submunition 10 float on the water in front of the watercraft 20 so that the submunition 10 submerges slightly when hit by the bow of the watercraft 20, then by way of the buoyancy of the submunition 10, the submunition 10 quickly recovers and is sucked into the intake 21 (see FIGS. 8 and 9) of the watercraft 20. The submunition 10 is then hit by the impeller 26 and bends around the leading edge of a blade of the impeller 26 and remains on the blade 27 of the impeller 26 by way of memory of the lanyard 4 and/or by way of an optional adhesive applied to the submunition 10. In some embodiments, once the engine of the watercraft 20 is stopped, the submunition 10 falls off of the blade 27 of the impeller 26, allowing future use of the watercraft 20 with no or minimal damage to the watercraft 20 and the impeller 26.

The submunition 10 comprises a buoyant body 7 with two endcaps 3/5 at each end. The endcaps 3/5 are connected to each other by a lanyard 4 (or other connecting member) that in some embodiments passes through the buoyant body 7. Each endcap 3/5 is affixed to respective ends of the lanyard 4 by any way known for affixing, including, but not limited to welding, soldering, adhesive, a knot, crimping, etc. For example, in FIGS. 4 and 5, the lanyard 4 is shown affixed to the endcaps 3/5 by a weld 9.

So that the submunition 10 floats in an upright fashion, the upper endcap 3 is of less mass than the lower endcap 5 and, therefore, when placed in water, the upper endcap 3 remains at or above the surface of the water and the lower endcap 5 sinks below the surface of the water. By providing this upright orientation, the probability of being sucked into the intake 21 of the watercraft 20 is greatly enhanced.

The buoyant body 7 is made of a material or has a structure that makes the buoyant body 7 lighter than water (e.g., sea water, river water, lake water), providing sufficient buoyancy as to keep the submunition 10 and endcaps 3/5 afloat until external forces are applied (e.g., until hit by the leading edge of a hull of the watercraft 20). In the example shown in FIG. 2, the buoyant body 7 is made of a material 1 that has a specific gravity relative to water that is less than 1.0. It is further desired that the overall specific gravity relative to water of the entire submunition 10 is less than 1.0, allowing the submunition 10 to partially float with the upper endcap 3 at or above the surface of the water. It is understood that the specific gravity with respect to water depends upon the type of water (e.g., salt water or fresh water) as well as the temperature and air pressure. To this, the submunition 10 is designed to operate in one or more types of target water (e.g. a submunition 10 designed for fresh water or a submunition 10 designed for salt water, etc.).

In some embodiments, the buoyant body 7 is made of a material 1 that is a foam material such as low-density polyethylene foam that is often used in packing materials. In some embodiments, the buoyant body 7 is made of a buoyant material 1 that is starch-based or starch-based foam that biodegrades relatively quickly when exposed to water. In some embodiments, the buoyant body 7 is made of a buoyant material 1 that is edible by marine life. In this embodiment, it is anticipated that when the blade 27 of the impeller 26 hits the submunition 10, the buoyant body 7 deforms or exits the submunition 10.

Figure 3:
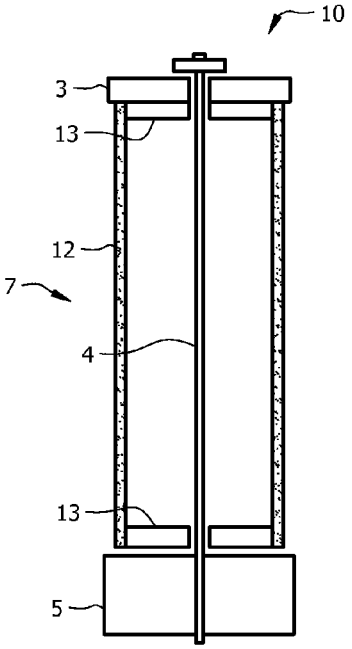
FIG. 3 illustrates a cross sectional view of a submunition.
Figure 4:
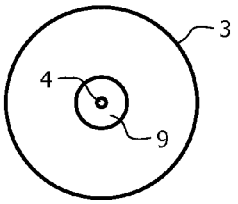
FIG. 4 illustrates a plan view of a first end of the submunition.
Figure 5:
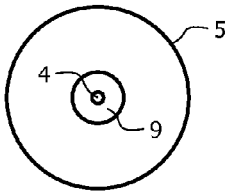
FIG. 5 illustrates a plan view of a second end of the submunition.

In some embodiments, as shown in FIG. 3, the buoyant body 7 is made as an enclosed tube 12 having seals 13 at each end, providing buoyancy due to air, gas, or, even by being evacuated within the cavity contained by the tube 12 and seals 13. In this embodiment, it is anticipated that when the blade 27 of the impeller 26 hits the submunition 10, the tube 12 fractures. In some embodiments, the enclosed tube 12 is the connecting member, connecting the end caps 3/5.

In some embodiments, as shown in FIG. 1, the buoyant body 7 is coated with an outer layer 15. In some such embodiments, the outer layer is made of paper or a water-soluble film that slows water ingress into the buoyant material 1, thereby slowing the decomposition of the buoyant material 1. In some embodiments, the outer layer 15 includes an adhesive that, when struck by a blade 27 of the impeller 26 of a watercraft 20, the adhesive of the outer layer 15 aids in adherence of the submunition 10 to the blade 27 of the impeller 26. In some embodiments, the adhesive is water activated or micro encapsulated to prevent the submunitions 10 from bonding to each other in the launch cartridge but then the submunitions 10 become sticky when exposed to water or when the submunitions 10 are hit by the impeller blade 27.

Although there is no limitation on size, it is preferred that the submunition be longer (the distance between the endcaps 3/5) than wider. In some embodiments, the submunitions are between 0.25 inches and 1.5 inches in diameter to facilitate passing through intake grates of target watercraft 20. In some embodiments, the submunitions 10 are less than 1.0 inch in diameter to facilitate passing through intake grates of target watercraft 20. In some embodiments, the submunitions 10 are less than 4.0 inches long (the distance between the endcaps 3/5) to facilitate passing through intake grates of target watercraft 20.

It is fully anticipated that the submunitions 10 are provided with a range or mix of shapes, diameters, and lengths to facilitate passing through intake grates of a variety of target watercrafts 20.

In some embodiments, the submunitions 10 have a proportion of their length above the water when floating vertically (endcap 5 submerged and endcap 3 at or above the surface), and in some such embodiments between one tenth and one third of the submunitions length is above the water when floating vertically, assuming a specific type of water such as fresh water, salt water, etc.

The lanyard 4 is made of a material that is sufficiently strong as to not break under the initial force of a hit by the blade 27 of the impeller 26. Suitable materials are fishing line, braided fishing line, annealed wire (e.g., baling wire), etc. Although not required, it is preferred to use a material that has plastic properties, in that, when bent, the material remains bent. For example, annealed wire will remain bent after the submunition 10 bends around the leading edge of the blade 27 of the impeller 26.

It is anticipated that in some embodiments the endcaps 3/5 are made of metal or ceramic with a central hole through which the lanyard 4 runs and is attached. To achieve an upright posture when in the water, the upper endcap 3 has less mass than the lower endcap 5. For example, the upper endcap 3 is a 24 gauge steel washer and the lower endcap 5 is a 12 gauge steel washer. In some embodiments, the endcaps 3/5 are made from a material that is not harmful to the environment and will eventually biodegrade such as steel or iron. In some embodiments, the lower endcap 5 is made from a formed piece of metal, shaped so as to create cavitation bubbles when the submunition 10 is situated on the leading edge of a rotating blade 27 of an impeller 26.

Figure 6:
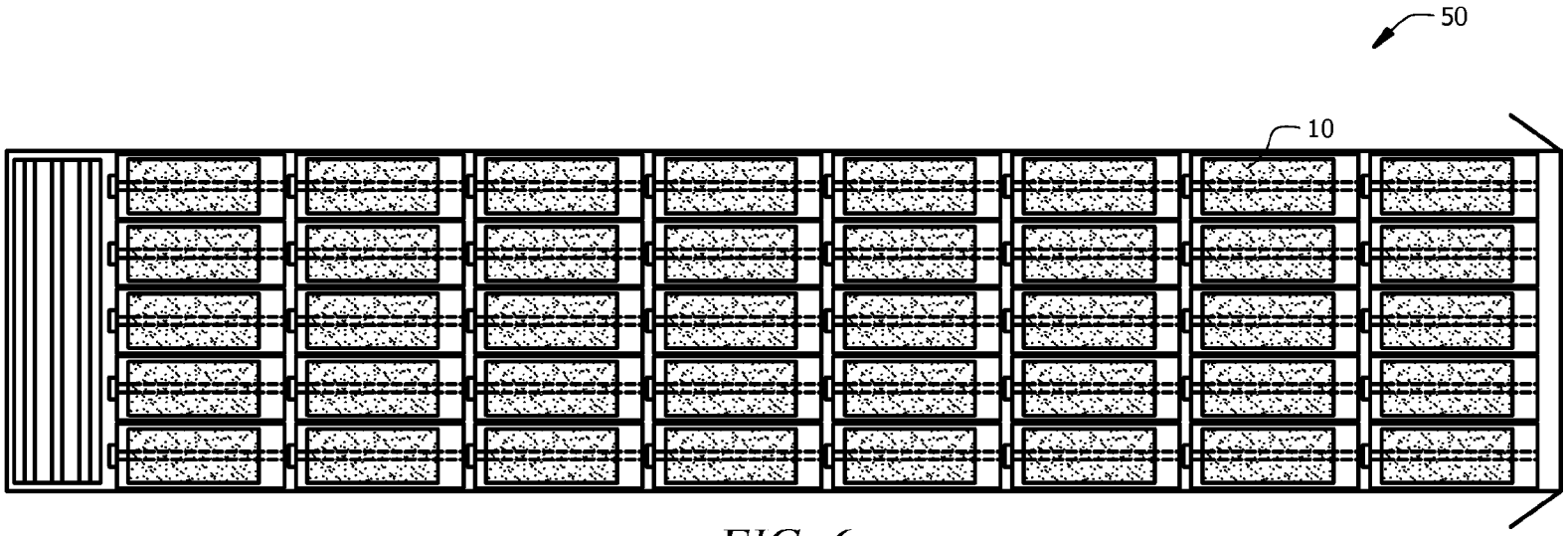
FIG. 6 illustrates multiple submunitions in a pack ready for deployment.

Referring to FIG. 6 illustrates multiple submunitions 10 in a pack 50 ready for deployment. In this example, the pack 50 is launched from a weapon by way of pneumatic pressure or an explosive charge, sending the multiple submunitions 10 into the air and, eventually, into the water preceding the path of the watercraft 20.

Referring to FIG. 7 illustrates the deployment of one or more submunitions 10 in advance of a watercraft 20. One or more of the submunitions 10 is launched into the water in front of a watercraft 20 (any impeller-propelled watercraft 20 such as a Jet Ski, etc.) by a propulsion mechanism 32 from, for example, a law enforcement vehicle (e.g. boat 30, helicopter, airplane, from land, etc.).

Referring to FIGS. 8 and 9, one of the submunitions 10 entering the intake 21 of a watercraft 20 (in FIG. 8) then adhering to a blade 27 of an impeller 26 of a watercraft (in FIG. 9) is shown. The intent is for one or more of the submunitions 10 to clamp onto the blade 27 of the impeller 26 (see FIG. 9) of the watercraft 20. Once one or more submunitions 10 clamps onto the blade 27 of the impeller 26; the submunition(s) 10 move with the blade 27 of the impeller 26 as it rotates, causing imbalance and cavitation within the impeller cavity 30. In FIG. 8, the watercraft 20 driven by a person 25 (perhaps a criminal or a person with a medical condition) is moving at a high rate of speed and the submunition 10 is floating in the path of the watercraft 20, then the submunition 10 is hit by the hull of the watercraft 20 and submerges, recovering to enter the intake 21 of the watercraft 20 within the propulsion shroud 30 where, as in FIG. 9, the submunition after being hit by the blade 27 of the impeller 26 holds onto the blade 27 of the impeller 26 causing cavitation within the propulsion shroud 30. The cavitation and imbalance reduces the output thrust 28/28' from a high output thrust 28 (see FIG. 8) to a low output thrust 28' (see FIG. 9). The low output thrust 28' allows a small amount of maneuverability and low speed so that the watercraft 20 has difficulty escaping the law enforcement vehicle (e.g. boat 32).

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of stopping an impeller-driven watercraft, the method comprising:

distributing a plurality of submunitions in advance of a path of the impeller-driven watercraft, each of the submunitions comprising:

a buoyant member consisting essentially of starch based foam;

a first end cap;

a second end cap, the second end cap is heavier than the first end cap;

and a lanyard connecting the first end cap to the second end cap;

at least one of the submunitions entering an intake vent of the impeller-driven watercraft, the at least one of the submunitions attaching to a blade of an impeller of the impeller-driven watercraft, causing cavitation and imbalance, thereby slowing the impeller-driven watercraft.

2. The method of claim 1, wherein a distance from the first end cap to the second end cap is less than 4.0 inches.

3. The method of claim 1, wherein a diameter of the submunition is between 0.25 inches and 1.5 inches.

4. The method of claim 1, wherein a diameter of the submunition is less than 1.0 inch.

5. The method of claim 1, wherein an adhesive coating is on a surface of the buoyant member and the adhesive coating sticks to the impeller of the impeller-driven watercraft.

* * * * *